US005655774A

United States Patent [19]

Cox

[11] Patent Number: 5,655,774

[45] Date of Patent: Aug. 12, 1997

[54] FOLDING, SLIDING, INTEGRATED SPORTS GOAL

[76] Inventor: Timothy T. Cox, 937 N. Lawrence St., Philadelphia, Pa. 19123

[21] Appl. No.: 629,354

[22] Filed: Apr. 5, 1996

[51] Int. Cl.[6] ..... A63B 63/00

[52] U.S. Cl. ..... 473/478; 273/400

[58] Field of Search ..... 273/400, 401, 273/402, 26 A, 411, 197, 127 B, 398, 399

[56] References Cited

U.S. PATENT DOCUMENTS 5,346,227 9/1994 Amram et al. ..... 273/400

*Primary Examiner*—Mark S. Graham

[57] ABSTRACT

A folding, portable sports goal comprised of hinged crossbar and bottom rail assemblies such that when frame members are detached at two points, the structure of the goal can be slid into an alternate embodiment and folded into a thin, integrated, planar configuration, that is portable and efficiently stored.

1 Claim, 3 Drawing Sheets

FOLDING, SLIDING, INTEGRATED SPORTS GOAL

BACKGROUND—CROSS-REFERENCES TO RELATED APPLICATIONS

This application relates to patent application Ser. No. 08/338,775, filed by Timothy T. Cox on Nov. 10, 1994. That application will be allowed to go abandoned as the current application contains significant improvements over the original invention.

BACKGROUND—FIELD OF INVENTION

This invention relates to folding, portable sports goals, specifically to the type that presents an inverted "U" shaped opening. Such goals are increasingly in demand due to the spreading popularity of such sports as street hockey and "kiddie" soccer. For reasons of security and convenience, it is desirable that such goals be portable and easily stored.

BACKGROUND—DESCRIPTION OF PRIOR ART

Many goals designed to meet this growing demand are constructed of a lightweight tubular material and connector fittings. However, most of these goals need to be disassembled into multiple parts for moving and storage. Such disassembly usually requires the separation of the netting from the goal structure. Reassembly can be time consuming and cumbersome. Loss of pieces can render the goal useless.

One notable exception to such a configuration is embodied in U.S. Pat. No. 5,346,227 which was issued Sep. 13, 1994 to Roger Amram and Michael Lemarche. In the initial embodiment described in that patent, the goal net comprises a single collapsing unit. However, such a configuration is clearly fragile at the joints where the described posts and bottom joining bars meet. Using the more stable alternate embodiment described in the Amram-Lemarche patent requires disassembly into four separate sections. Loss of any one of these sections would render the goal useless or unstable. Whichever configuration of the described invention is used, disassembly requires at least ten disjunctions. Furthermore, the Amram-Lamarche design places the netting material in contact with the ground, which will inevitably cause early wear.

OBJECTS AND ADVANTAGES

The objects of this invention are ease of portability, efficiency of storage, conservation of parts, and quickness of set-up and break-down. The foldability of the goal and the use of lightweight tubing in its construction, make it easily portable. The planar structure of its folded embodiment make its storage very convenient, with the option of hanging it on a wall. The integrity of its components means there is no danger of misplaced parts. The life of the netting is elongated by being held out of contact with the ground. With only a sliding operation and two connections to be made during set-up, the goal frame may be assembled erect by even a small child in a matter of seconds. Break-down is similarly a rapid endeavor.

From a manufacturing standpoint, the design of my invention is highly advantageous. The parts are low-cost and few in number while the labor required is simple and fast.

In the absence of an actual goal enclosure, informal sports games the world over are often conflicted by disputes over whether or not a goal took place. This invention offers a low cost remedy to that situation.

From a humanitarian standpoint, this goal could allow children all over the world access to a form of semi-organized sports which might help in their physical development and enjoyment of life.

BRIEF DESCRIPTIONS OF THE DRAWINGS

DETAILED DESCRIPTION OF THE INVENTION

Figure 1:
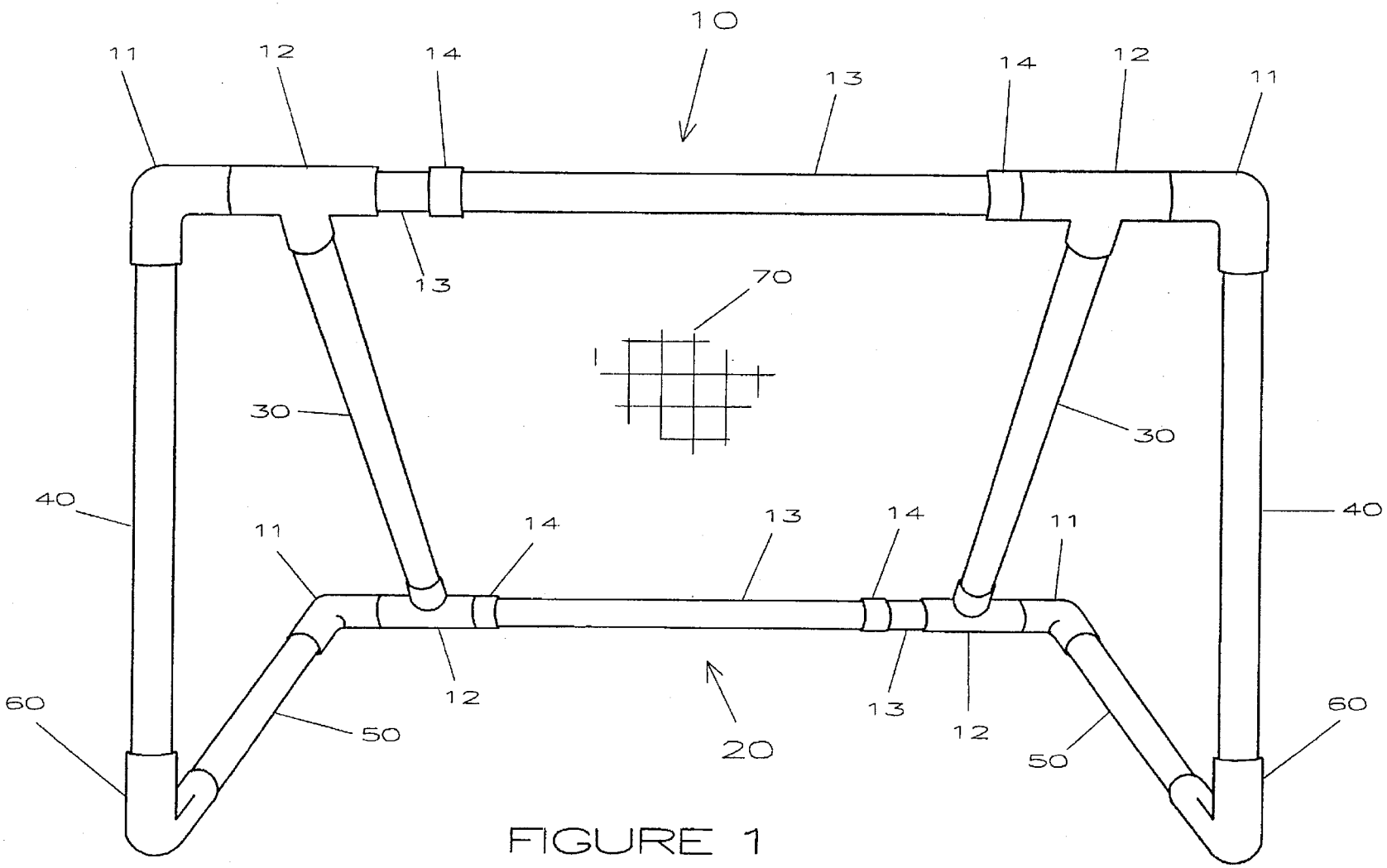
FIG. 1 shows the goal frame when in an erected position as viewed from the front.

Referring to FIG. 1, the goal frame consists of an upper crossbar assembly 10, a bottom rail assembly 20, adjoining diagonal struts 30, vertical arms 40 and horizontal legs 50. The arms and legs are detachably connected by elbow fittings 60, which are affixed to the forward ends of the legs.

The key to the invention lies in the construction of said upper crossbar and bottom rail assemblies. Identical to one another, each is composed of a tube 13, two stop rings 14, two tees 12, and two elbows 11. The tees and the stop rings are reamed out so that they may slide freely on the tube. The elbows are affixed in parallel at either end of the tube. The stop rings are positioned and affixed to the tube in such a manner that one of the tees is held in place between a stop ring and an elbow, while the other tee, positioned at the opposite end of the tube, is given a latitude of movement between the elbow at that end and the other stop ring. This latitude of movement approximates the width of an elbow fitting.

The two assemblies, parallel and spaced apart, are positioned such that the ends permitting latitude of tee movement are at opposite ends, in one case positioned to the left of the assembly, and in the other case to the right. The two assemblies are adjoined to one another by the diagonal struts 30, which interconnect the respective left positioned tees and right positioned tees 12 of each assembly.

When pressure is applied outward on the two struts 30, away from each other, all four tees 12 come to abut the terminal elbows 11 of the two assemblies as shown in FIG. 1. The elbows 11 at either end of the assemblies become aligned with their opposite number.

Figure 2:
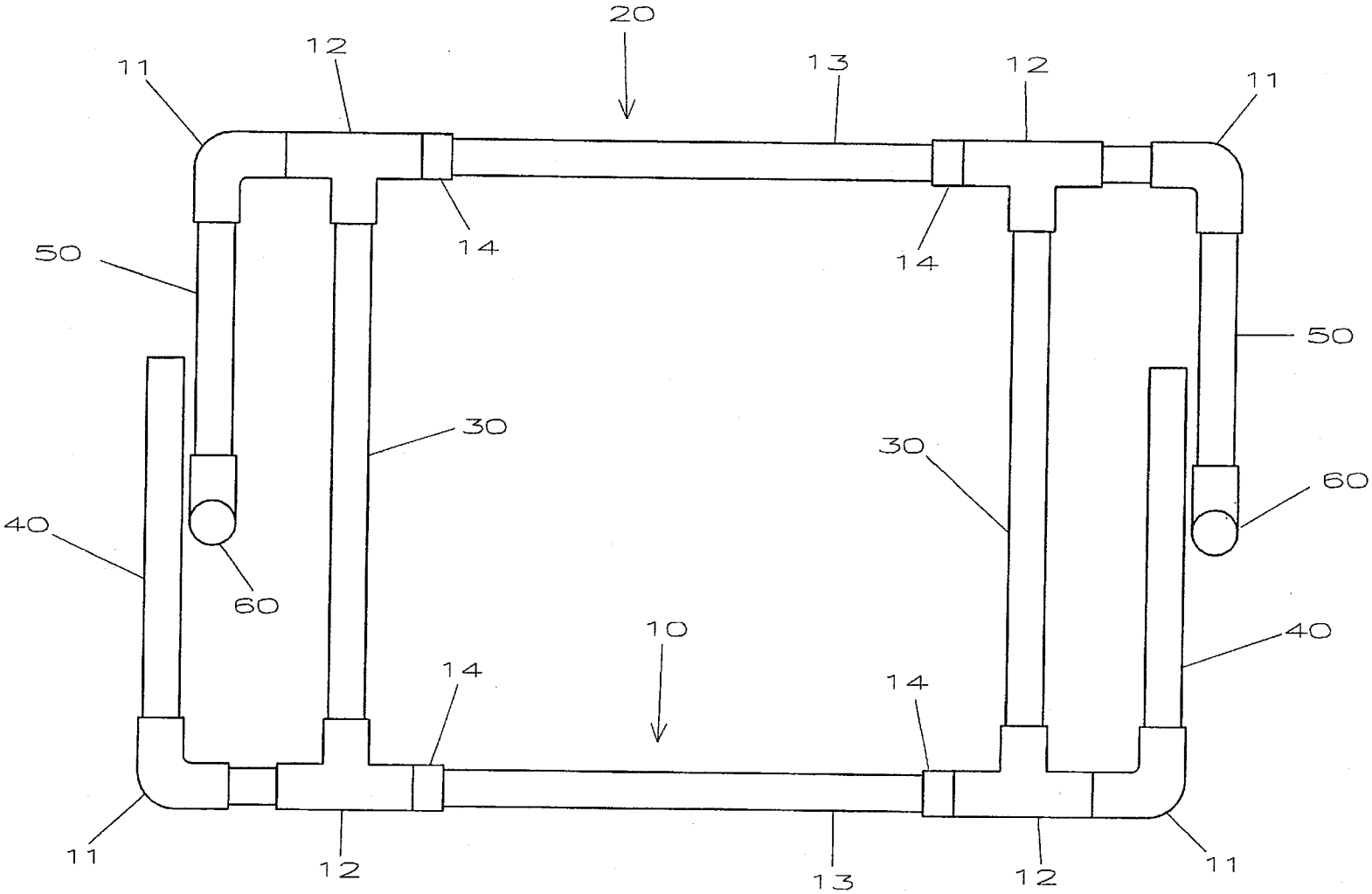
FIG. 2 shows the goal frame when in a folded position as viewed from above.

However, when the struts 30 are drawn inward, towards one another, the two tees with latitude of movement, one on each of the two assemblies, move to abut their associated stop rings 14. Simultaneously, the two assemblies move laterally with regards to one another, one to the left and the other to the right. The terminal elbows become positioned out of line with their opposite number by the width of an elbow fitting as seen in FIG. 2.

It is this lateral movement of the crossbar and bottom rail assemblies with regards to one another that allows for the planar configuration of the folded embodiment of the goal frame. For when the arms and legs are attached to the terminal elbows of the assemblies, and those respective elbows are out of line with one another by the width of an elbow fitting, the arms and legs may occupy the same plane when in a folded position as seen in FIG. 2.

Figure 3:
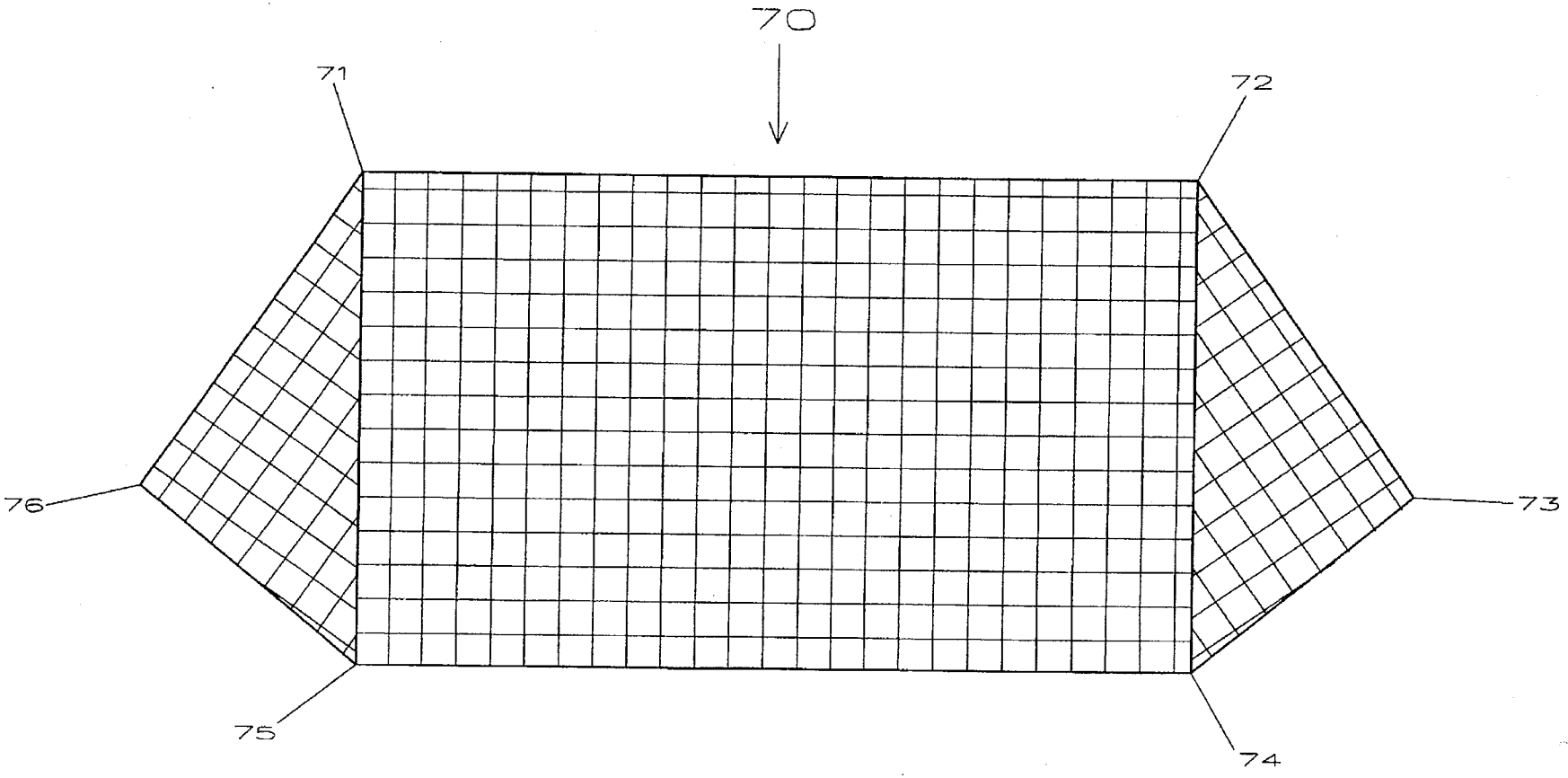
FIG. 3 shows the net when laid out flat.

A net 70, as seen in FIG. 3, is constructed in a shape defined by the sides and back of the goal frame. Points 71, 72, 74 and 75 are attached to the four elbows 11. Two holes are drilled in each elbow 11 through which a wire runs and attaches to the four mentioned points of the netting. A concave washer is riveted to the outer surface of each of the elbows 60, to which netting points 73 and 76 may be detachably connected. In all cases, attachments are positioned such that the netting does not contact the ground.

A bolt is affixed towards the center of each strut 30, to which the detached points of the netting 73 and 76 may be attached when the goal frame is in a folded position. This ability permits the goal to be retained in its folded position.

In short, the folding operation of the goal from the erect position of FIG. 1 to the folded position of FIG. 2 involves detaching the netting from the elbows 60, pulling the arms 40 upwards out of these elbows, pulling the struts 30 towards one another, folding the arms 40 and legs 50, side by side, into the same plane, and finally reattaching the unattached points of netting 73 and 76, to the bolts on the struts. The tight, planar package is ready for transport and storage.

The set-up operation is the reverse of the folding operation.

Having described my invention, I claim:

1. A folding integrated sports goal comprising, in combination:

front frame means defining an inverted, upright U-shaped opening, including two vertical, parallel, spaced-apart, two-ended front frame members, each with a base and an upper end, and connected at their upper ends to elbow fittings at either end of a horizontally disposed, two-ended crossbar assembly;

bottom frame means defining a rearward oriented, horizontally disposed U-shaped structure including two horizontal, parallel, spaced-apart, two-ended bottom frame members each detachably connected towards one end by elbow fittings to said bases of said respective vertical frame members of said front frame means, and connected towards the other end to elbow fittings at either end of a horizontally disposed, two-ended, bottom-rail assembly;

said crossbar and bottom rail assemblies each being comprised of a two-ended frame rod which penetrates T-fittings and upon which said T-fittings are able to slide and rotate, with one such T-fitting positioned towards one end and another towards the other end of each said frame rod; parallel-oriented elbow fittings attached to either end of each frame rod; and stop means for limiting sliding movement of the T-fittings attached to the outer surface of each frame rod between the T-fittings;

diagonal frame means including a first diagonal frame member interconnecting T-fittings of the two assemblies and a second diagonal frame member interconnecting the T-fittings of the two assemblies.

* * * * *